United States Patent [19]

Jahnke

[11] Patent Number: 4,710,722

[45] Date of Patent: Dec. 1, 1987

[54] APPARATUS GENERATING A MAGNETIC FIELD FOR A PARTICLE ACCELERATOR

[75] Inventor: Andreas Jahnke, Forchheim, Fed. Rep. of Germany

[73] Assignee: Siemens Aktiengesellschaft, Munich

[21] Appl. No.: 833,726

[22] Filed: Feb. 26, 1986

[30] Foreign Application Priority Data

Mar. 8, 1985 [DE] Fed. Rep. of Germany ..... 3508334

[51] Int. Cl.[4] ..... H05H 7/00; H05H 13/00

[52] U.S. Cl. ..... 328/234; 250/396 ML; 313/62

[58] Field of Search ..... 250/396 ML; 328/234, 328/230; 313/62

[56] References Cited

U.S. PATENT DOCUMENTS

| | | | |
|---|---|---|---|
| 3,344,357 | 9/1967 | Blewett | 313/62 |
| 4,123,720 | 10/1978 | Rosander et al. | 328/234 |
| 4,200,844 | 4/1980 | Numan | 328/234 |
| 4,623,847 | 11/1986 | Anderberg et al. | 313/62 |

FOREIGN PATENT DOCUMENTS

| | | | |
|---|---|---|---|
| 2446142 | 4/1976 | Fed. Rep. of Germany | 328/234 |

OTHER PUBLICATIONS

"Studies of 400 GeV Superconducting Proton Storage Rings", Blechschmidt et al., Nucl. Inst. & Methods, No. 3, Nov. 1978, pp. 375–409.

Nuclear Instruments and Methods: vol. 203, 1982, pp. 1–5, vol. 177, 1980, pp. 411–416, vol. 204, 1982, pp. 1–20, vol. 121, 1974, pp. 525–532.

IEEE Transactions on Nuclear Science, vol. NS-30, No. 4, Aug. 1983, 2531–2533.

*Primary Examiner*—Bruce C. Anderson

*Attorney, Agent, or Firm*—Kenyon & Kenyon

[57] ABSTRACT

Magnetic field-generating apparatus for an installation for accelerating electrically charged particles, the particle track of which comprises curved and straight sections, contains main magnetic field generating windings and at least one supplemental winding which is provided for focusing the particles on the particle track. It should be possible to accelerate relatively large particle streams to relatively high energy levels without the need for separate preaccelerators. In the region of at least one of the curved sections of the particle track the supplemental winding is designed as a conductor arrangement forming a quadrupole triplet for focusing the particles during their acceleration phase, the turns of the supplemental winding being arranged on both sides of the plane in which the particle track lies. In particular, a conductor arrangement forming a quadrupole triplet can be provided in both regions of the curved sections of the particle track wherein these conductor arrangements together form a double-telescope system for focusing the particles.

8 Claims, 4 Drawing Figures

APPARATUS GENERATING A MAGNETIC FIELD FOR A PARTICLE ACCELERATOR

BACKGROUND OF THE INVENTION

The present invention relates to apparatus generating a magnetic field for an installation for the acceleration of electrically charged particles, the particle track of which contains curved and straight sections, comprising windings which generate a magnetic field and of which at least one supplemental winding is provided for focusing the particles on the particle track. Such apparatus are known, for instance, from the publication "Nuclear Instruments and Methods", vol. 203, 1982, pages 1 to 5.

With known smaller electron accelerators of circular shape, which are also called "microtrons", particle energies to approximately 100 MeV can be achieved with normal conducting magnetic field generating windings. These installations can also be realized, in particular, as so-called "racetrack microtrons". The particle tracks of this type of accelerator comprise two semicircles each with a corresponding 180° deflection magnet and two straight track sections (see "Nuclear Instruments and Methods", vol. 177, 1980, pages 411 to 416, or vol. 204, 1982, pages 1 to 20).

If the desired final energy of the electron is to be increased from about 100 MeV to substantially higher values of, for instance, 700 MeV, an increase of the magnetic field is available while the dimensions of the particle track remain unchanged. Such an increase can be achieved particularly with superconducting magnets. If, however, low-energy electrons are injected with a very weak magnetic field into a microtron which, in addition, comprises superconducting magnet windings, a number of possible field error sources must be noted in order to keep the electron losses low during the acceleration phase, since at the start of this phase, the field level for electrons injected at low energies of, for instance, 100 keV, is only about 2.2 mT with a radius of curvature of the accelerator of, for instance, 0.5 m. With such low magnet field strengths or also with high field change rates, the danger then exists, however, that the field error limit may be exceeded because of field distorting error sources. In order to be able to guide an electron beam by weak focusing, a field accuracy $\Delta B/B_0$ of about $10^{-3}$ would be required in the above-mentioned case; this means that the field would have to be adjustable with an accuracy of about 0.002 mT at the start of the acceleration phase. Then, however, external fields such as the Earth's field with 0.06 mT or fields of magnetizable, i.e., para-, ferri- or ferromagnetic parts of the magnetic apparatus itself can be the cause of undesirable field distortions. Also, eddy currents in metallic parts of the magnetic apparatus or in its conductors can lead to such disturbances. In addition, shielding currents in the conductors of the superconducting winding or so-called frozen magnetic fluxes in these conductors can represent such disturbance sources.

It has been attempted to eliminate difficulties due to such interference field sources, for instance, by shielding or compensating the interference fields. Thus, a shielding effect by means of a flux return of iron has been attempted in known electron accelerators with normal-conducting copper coils. In additon, also laminating of the iron yokes of the field-generating magnets for suppressing the development of eddy currents is known. Optionally, a field reversal can also be carried out in order to traverse the hysteresis curve of the iron of the magnetic apparatus in a reproducible manner.

If the particles are to be injected into the particle accelerator track with a relatively low energy, a further difficulty results if relatively large particle currents are to be generated, since then the repulsion forces acting between the individual particles, i.e. the space charge forces are relatively dominant; i.e., the particle current attempts to diverge accordingly. One is therefore forced to provide additional measures for focusing the particle beam. In the electron accelerator found in the literature reference "Nuclear Instruments and Methods" mentioned above, the 180° deflection magnets comprise, with a main winding generating a dipole field, also a supplemental winding focusing the particles onto the particle track. In addition, a focusing solenoid system is provided in the region of the straight track sections. However, in the known magnetic apparatus, the normal conducting deflection magnets surround with their iron yokes the respective curved section of the particle track for reasons of the desired field accuracy, so that the synchrotron radiation occurring there cannot be utilized.

Due to the disturbing effects on low energy particle beams resulting if superconducting deflection magnets are used, the particles, in known accelerators, are generally injected only at a higher field level, i.e., with higher energy, since then, the mentioned disturbing effects are only of smaller or secondary significance. Such a mode of operation of the accelerators, however, requires appropriate preaccelerators and is therefore accordingly costly.

SUMMARY OF THE INVENTION

It is therefore an object of the present invention to develop the magnetic field-generating apparatus mentioned above, of a particle accelerator, such that with it, relatively large currents of electrically charged particles can be accelerated to relatively high energy levels, in the case of electrons, to, for instance, several 100 MeV without the need of separate preaccelerators.

According to the invention, the above and other objects are achieved by the provision that, in the vicinity of at least one of the curved sections of the particle track, the supplemental winding is realized as a conductor arrangement forming a quadrupole triplet for focusing the particles during the acceleration phase, the turns of the supplemental winding being arranged on both sides of the plane in which the particle track lies.

Systems of three quadrupole windings or coils arranged in tandem, so-called quadrupole triplets for focusing beams of electrically charged particles, are generally known. Thus, in the publication "Nuclear Instruments and Methods", vol. 121, 1974, pages 525 to 532, a beam-guiding system which comprises several such quadrupole triplets in straight sections of its particle track is shown. With such quadrupole triplets can also be designed, in particular, double-telescope beam guiding systems, each of which comprises two quadrupole triplets which are surrounded symmetrically by equal drift sections of predetermined length. Each quadrupole triplet of such a system is excited electrically such that the horizontal as well as the vertical focusing plane coincides with the start of the preceding drift section as seen in the direction of the guided beam, as well as with the end of the following drift section.

The advantages connected with the embodiments of the magnetic field generating apparatus according to the invention are, in particular, that also superconducting deflection magnets for fields between about 2 mT and 100 mT can be utilized in the acceleration of, particularly, electrons, in that focusing of the correspondingly low-energy particles on the particle track can be assured by the at least one quadrupole triplet. Due to the special arrangement of the turns of the conductor arrangement forming the quadrupole triplet, the emission of synchrotron radiation laterally outward is not impeded in this arrangement.

BRIEF DESCRIPTION OF THE DRAWINGS

The invention will be described in greater detail in the following description with reference to the drawings, in which.

DETAILED DESCRIPTION

With reference now to the drawings, the magnetic field-generating apparatus according to the invention is to be provided particularly for electron accelerators, known per se, of the "racetrack" type. The dipole deflection magnets required therefor are bent in the shape of semicircles corresponding to the curved particle track (see, for instance, "IEEE Trans. Nucl. Sci.", vol. NS-30, no. 4, August 1983, pages 2531 to 2533). Since in particular, final energies of the particles of several hundred MeV are desired, the main windings of the deflection magnets are preferably made of superconducting material because of the required high field strengths. By the embodiment according to the invention of the magnetic field generating apparatus, quadrupole fields with supplemental windings are to be developed in addition to the dipole field which is brought about by the main windings of these deflection magnets and which at the same time make possible an undisturbed outlet of the synchrotron radiation. Additional focusing of the electron beam during the still low-energy acceleration phase of the electrons can be achieved so that then, also superconducting main windings of the deflection magnets can be used. Because of the additional focusing, it is therefore possible to inject into the particle track electrons having a relatively low injection energy of, for instance, several hundred keV and with a relatively large particle density, i.e., a pulse current of, for instance, at least 20 mA with pulse widths in the microsecond range; separate preaccelerators for injecting electrons with higher energy can then advantageously be dispensed with. The superconducting deflection magnets can thus also be used for fields between about 2 mT and 100 mT in the acceleration of the electrons. The corresponding supplemental windings for generating the additional quadrupole fields are advantageously arranged in the region of the superconducting deflection magnets. These supplemental windings can be made with normal conducting conductors as well as, in particular, with superconducting conductors. They are schematically indicated in a top view in FIG. 1, a presentation of the superconducting main windings of the 180° deflection magnets having been dispensed with for reasons of clarity.

Figure 1:
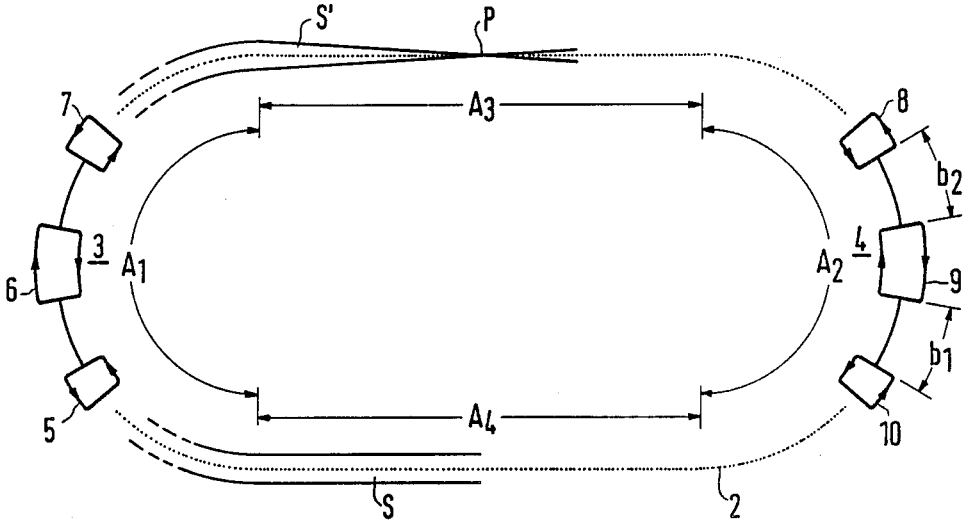
FIG. 1 shows the particle track of a magnetic field generating apparatus with supplemental windings according to the invention.

The particle track 2 of the racetrack type, shown in FIG. 1, comprises two curved track sections $A_1$ and $A_2$, between which straight track sections $A_3$ and $A_4$ extend. In the range of the curved track sections $A_1$ and $A_2$, a conductor arrangement 3 and 4 with a corresponding curvature of its conductor parts is provided which is designed as a triplet of three quadrupole windings 5 to 7 and 8 to 10, which are arranged as a triplet arranged one behind the other as seen in the beam guidance direction and are electrically connected to each other. The two quadrupole triplets 3 and 4 form a double telescopic beam guidance system. Such systems with such quadrupole triplets are known per se (see, for instance, "Nuclear Instruments and Methods", vol. 121, 1974, pages to 525 to 532). As is well known, a beam can be focused by such triplets to a point of the particle track in the vertical as well as in the horizontal direction. According to the embodiment shown, a particle stream designated with S which is formed in the straight section $A_4$ of the particle track by approximately parallel-flying particles, is focused on a point P by means of the quadrupole triplet 3 as the beam S' which is situated approximately in the center of the axial extent of the straight section $A_3$ of the particle track 2. By the quadrupole triplet 4, this particle beam S' which is focused on the point P and diverges correspondingly after this point is changed into the particle beam S formed by parallel-flying particles in the straight section $A_4$ of the particle track. Such a system with point-to-parallel and parallel-to-point imaging is called double-telescopic. The current flow directions to be adjusted for this purpose in the turns of the quadrupole coils 5 to 7 and 8 to 10 which can be seen in the top view of FIG. 1, are illustrated by individual lines with arrows at the turns located above the particle track.

Figure 2:
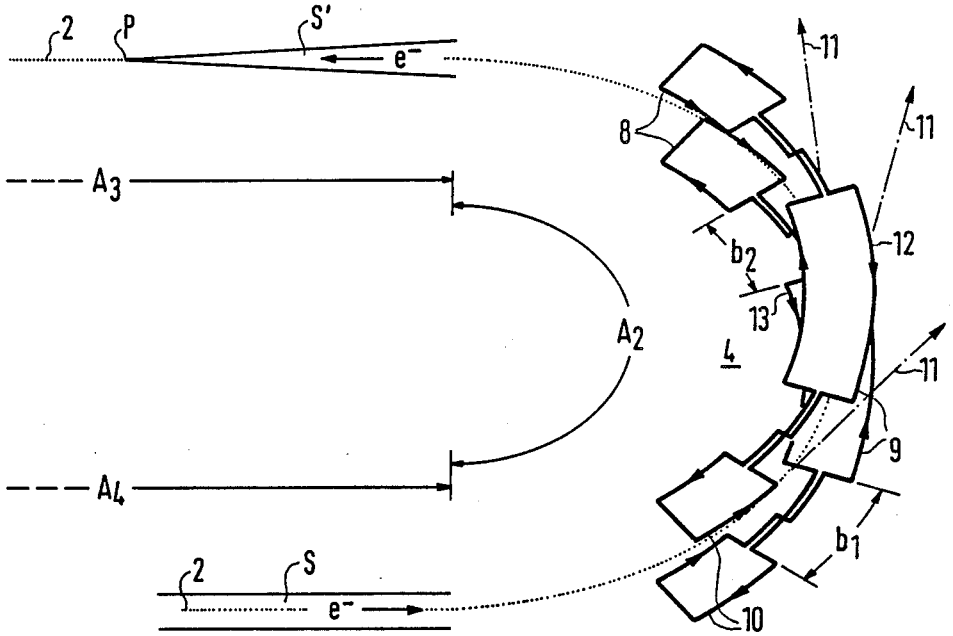
FIG. 2 shows schematically such a supplemental winding in a perspective view.

These current flow directions are shown in detail in FIG. 2. In this figure, a conductor arrangement for generating superposed quadrupole fields which form a triplet is shown in a perspective view. This quadrupole triplet is, for instance, the triplet 4 according to FIG. 1. The magnetic quadrupole fields of the triplet are generated by two current conductors 12 and 13 which are arranged in parallel planes always on one side relative to that plane in which the particle track 2 lies. In this arrangement, the lateral radiation of synchrotron light which occurs with higher energies and which is to be illustrated by dash-dotted lines 11 with arrows, is not impeded. Regions without quadrupole fields which are designated in the figure with $b_1$ and $b_2$, respectively, are bridged by putting together outgoing and returning conductor parts. A rotation of the quadrupole field by 90° is generated by crossing the conductor parts in these regions. In order to achieve small angle divergences, the axial lengths of the drift sections ($1_d$) and the quadrupole triplet ($1_q$) are advantageously chosen in a ratio of $1_d$: $1_q$: $1_d$ such as 1.5:1:1.5. The triplet is composed of three quadrupoles and two drift sections, the lengths $1_q$ and $1_d$ of which have the ratio $1_{q:d}$:$1_q$:$1_d$:$1_q$ such as 0.125:0.25:0.25:0.250.125. 1 The field intensity of the quadrupole field should be distinctly above that of the interference fields. For instance, a quadrupole field with a gradient of about 0.18 T/m belongs to a dipole field of 70 mT which corresponds to an electron energy of about 10 MeV. This gradient requires an electric excitation of the triplet coils 12 and 13 of about 700 ampere-turns with a distance of 4 cm from the electron track 2.

Figure 3:
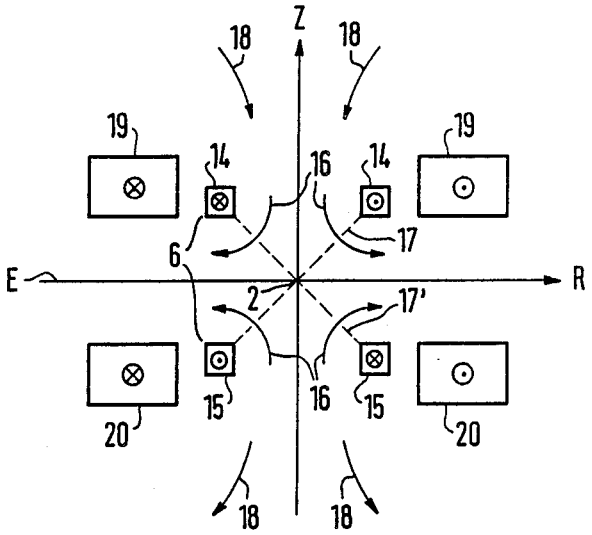
FIGS. 3 and 4 show two cross sections through such a supplemental winding.
Figure 4:
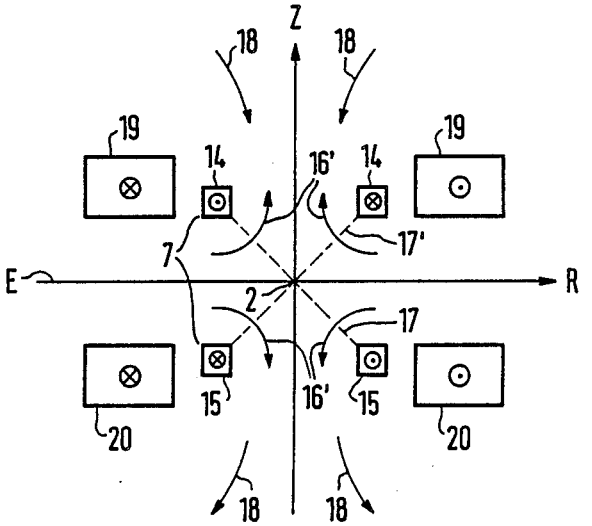

The conductors of the quadrupole triplets can advantageously be built into the respective deflection magnet in a simple manner. This is shown in FIGS. 3 and 4. FIG. 3 shows schematically a cross section through the quadrupole coil 6 of the conductor arrangement according to FIG. 1 which forms the quadrupole triplet 3. The quadrupole 6 is formed by an upper conductor turn 14 and a lower conductor turn 15. These turns are arranged on both sides of a plane E in which the particle track 2 and the radius of curvature R of the deflection magnet lie. According to the illustration, the particle track 2 goes through the origin of a coordinate system with R and Z as the coordinates, Z being perpendicular to the plane E and to R, respectively. According to the invention, the conductor turns 14 and 15 should be arranged symmetrically with respect to the plane E. With these conductor turns, a quadrupole field can be generated which acts on the particle beam with a focusing at angle of +45°. The quadrupole field is illustrated by field lines 16 while the focusing and defocusing direction of the Lorentz force is indicated by dashed lines 17 and 17', respectively. This quadrupole field is superimposed by a dipole field which is indicated by field lines 18 and is generated by main windings 19 and 20 of the 180° deflection magnet. The two main windings 19 and 20 are approximately symmetrical to both sides of the plane E. With such an arrangement of the dipole and quadrupole windings it is achieved, for one, that the synchrotron radiation which occurs in the region of the deflection magnets can come to the outside unimpeded in the plane E. If, in addition, superconducting conductors are used also for the quadrupole coils, these conductors can, on the other hand, in the cryo-system containing the adjacent dipole winding, be arranged in a simple manner at the same time.

FIG. 4 shows schematically, in a presentation corresponding to FIG. 3, a cross section through the quadrupole coil 7 of the same quadrupole triplet 3. The current flow directions in the upper turn 14 and in the lower turn 15 of this coil 7 are opposed to the current flow direction in the adjacent quadrupole coil 6 of the triplet 3 so that the quadrupole field of coil 7, which is illustrated by the field lines 16', has a focusing or defocusing effect with an angle of −45°. This means that the quadrupole field of the coil 7 is rotated 90° relative to the quadrupole field of coil 6 shown in FIG. 3. According to the current flow directions in the conductor turns of the quadrupole coil 7, also the current flow directions in the quadrupole coil 5 must be chosen. This means that in the quadrupole triplet 3, such current directions in the conductor turns are provided in the quadrupole coils 5 to 7 arranged one behind the other such that the sign of the focusing effect changes from coil to coil. The same applies also for the quadrupole coils 8 to 10 of the quadrupole triplet 4.

The quadrupole fields which can be brought about by the embodiment of the magnetic field-generating apparatus according to the invention, are substantially effective only for small dipole fields and high field change rates. At higher fields with $B > 1T$ and lower field change rates $\dot{B}$, such supplemental fields are largely unnecessary because then, the main windings of the magnetic field generating apparatus can take over the guidance of the particles alone.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are, accordingly, to be regarded in an illustrative rather than a restrictive sense.

What is claimed is:

1. Magnetic field-generating apparatus for an installation for accelerating electrically charged particles, the particle track of which has a plurality of curved and straight sections, comprising a plurality of main magnetic field generating windings located in the curved sections and at least one supplemental winding provided for focusing the particles on the particle track, the supplemental winding comprising a quadrupole triplet conductor arrangement in the region of at least one of the curved sections of the particle track, forming a quadrupole triplet for focusing the particles during acceleration, the turns of the supplement winding being arranged on both sides of the plane in which the article track is disposed.

2. The apparatus recited in claim 1, wherein the current flow directions in corresponding turns of adjacent quadrupole windings of the quadrupole triplet conductor arrangement are opposed.

3. The apparatus recited in claim 1 wherein at least one of the main windings generating the magnetic field and the quadrupole triplet conductor arrangement forming the quadrupole triplet contain, at least in part, superconducting conductors.

4. The apparatus recited in claim 1, wherein the particle track has two curved sections and in each region of the two curved sections, a quadrupole triplet conductor arrangement is provided forming a quadrupole triplet.

5. The apparatus recited in claim 4, wherein the two quadrupole triplet conductor arrangements each forming a quadrupole triplet form a double-telescope system for focusing the particles.

6. The apparatus recited in claim 1, wherein the quadrupole triplet conductor arrangement include drift sections and the extend ($1_d$) of the drigt sections and the extent ($1_q$) of the quadrupole triplet in the beam guiding direction are chosen in a ration such that at least approximately $1_d$:$1_q$:$1_d$ equal to 1.5:1:1.5 applies.

7. The apparatus recited in claim 1, wherein each quadrupole winding of the quadrupole triplet conductor arrangement comprises at least one conductor turn on each of said both sides of said plane.

8. The apparatus recited in claim 1, wherein electrons are to be accelerated as the electrically charged particles.

* * * * *